United States Patent [19]

Deutsch

[11] 4,281,574

[45] Aug. 4, 1981

[54] SIGNAL DELAY TONE SYNTHESIZER

[75] Inventor: Ralph Deutsch, Sherman Oaks, Calif.

[73] Assignee: Kawai Musical Instrument Mfg. Co. Ltd., Hamamatsu, Japan

[21] Appl. No.: 73,665

[22] Filed: Sep. 10, 1979

Related U.S. Application Data

[63] Continuation of Ser. No. 885,561, Mar. 13, 1978, abandoned.

[51] Int. Cl.[3] ..... G10H 1/12; G10H 7/00

[52] U.S. Cl. ..... 84/1.19; 84/1.21; 84/1.22; 364/768

[58] Field of Search ..... 84/1.01, 1.03, 1.11, 84/1.12, 1.19–1.22, 1.24, DIG. 9; 179/1 D, 1 J, 1 M; 333/165; 364/419, 718, 724, 768

[56] References Cited

U.S. PATENT DOCUMENTS

| | | | |
|---|---|---|---|
| 3,992,971 | 11/1976 | Chibana et al. | 84/1.03 X |
| 4,005,268 | 1/1977 | Canell et al. | 179/1 J |
| 4,012,982 | 3/1977 | Southard | 84/1.01 |
| 4,036,096 | 7/1977 | Tomisawa et al. | 84/1.01 |
| 4,130,043 | 12/1978 | Niimi | 84/1.03 |
| 4,135,424 | 1/1979 | Okamoto | 84/1.03 X |

*Primary Examiner*—Stanley J. Witkowski
*Attorney, Agent, or Firm*—Christie, Parker & Hale

[57] ABSTRACT

A tone synthesizer for generating a musical tone where harmonic content can be varied with time to produce unique sound effects. This is accomplished by generating waveform data in time sequence, delaying the waveform data by a time interval that is variable, and subtracting the delayed data from the waveform data to provide a modified sequence of waveform data which is then converted to an audio wave.

8 Claims, 8 Drawing Figures

SIGNAL DELAY TONE SYNTHESIZER

CROSS REFERENCE TO RELATED APPLICATIONS

This is a continuation of application Ser. No. 885,561, filed Mar. 13, 1978, and now abandoned.

FIELD OF THE INVENTION

This invention relates to electronic tone synthesizers, and more particularly, to a tone synthesizer using variable time delays to generate a tone having changing harmonic content.

BACKGROUND OF THE INVENTION

Tone synthesizers in which an aduio tone rich in harmonics is passed through a sliding formant filter to produce a time-varying tonal effect by altering the higher frequency components of the signal are well known. In analog systems, the sliding formant filter may be a high or low pass filter in which the cutoff frequency may be varied with time to change the harmonic content of the output of the filter. In digital systems, the equivalent effect of a sliding formant filter is achieved by scaling the harmonic coefficients before they are used in a computational alogorithm to obtain amplitude values determining points of the musical waveshape of the tone being generated. Digital systems having the equivalent effect of a sliding formant are described, for example, in U.S. Pat. No. 3,956,960 entitled "Formant Filtering in a Computer Organ" and in copending application Ser. No. 603,776, filed Aug. 11, 1975, entitled "Polyphonic Tone Synthesizer", now issued as U.S. Pat. No. 4,085,644. Scaling of the coefficients, however, requires the use of a digital multiplier, which is a relatively expensive circuit element.

SUMMARY OF THE INVENTION

The present invention provides an arrangement for achieving a time-varying harmonic structure of a polyphonic tone digitally without the use of a multiplier. The present invention achieves an equivalent effect by modifying the data representing the amplitude points of the musical waveshape. Specifically, each amplitude point is modified by adding or substracting a prior in time amplitude point. The delay time can be varied so that any one of a number of prior data points can be selected for addition or substraction with the current amplitude point. A source of sequential data representing changes in amplitude of a sound wave as a function of time are connected to a variable delay means, such as a shift register, which provides temporary storage of a group of sequential data points on a first-in, first-out basis. Any one of the data points stored in the shift register can be selected as one input to a subtract or add circuit together with the current data point from the source. Each resultant value is then applied to a digial-to-analog converter to provide an audio output signal.

DESCRIPTION OF THE DRAWINGS

For a more complete understanding of the invention reference should be made to the accompanying drawings, wherein.

DETAIL DESCRIPTION

Figure 1:
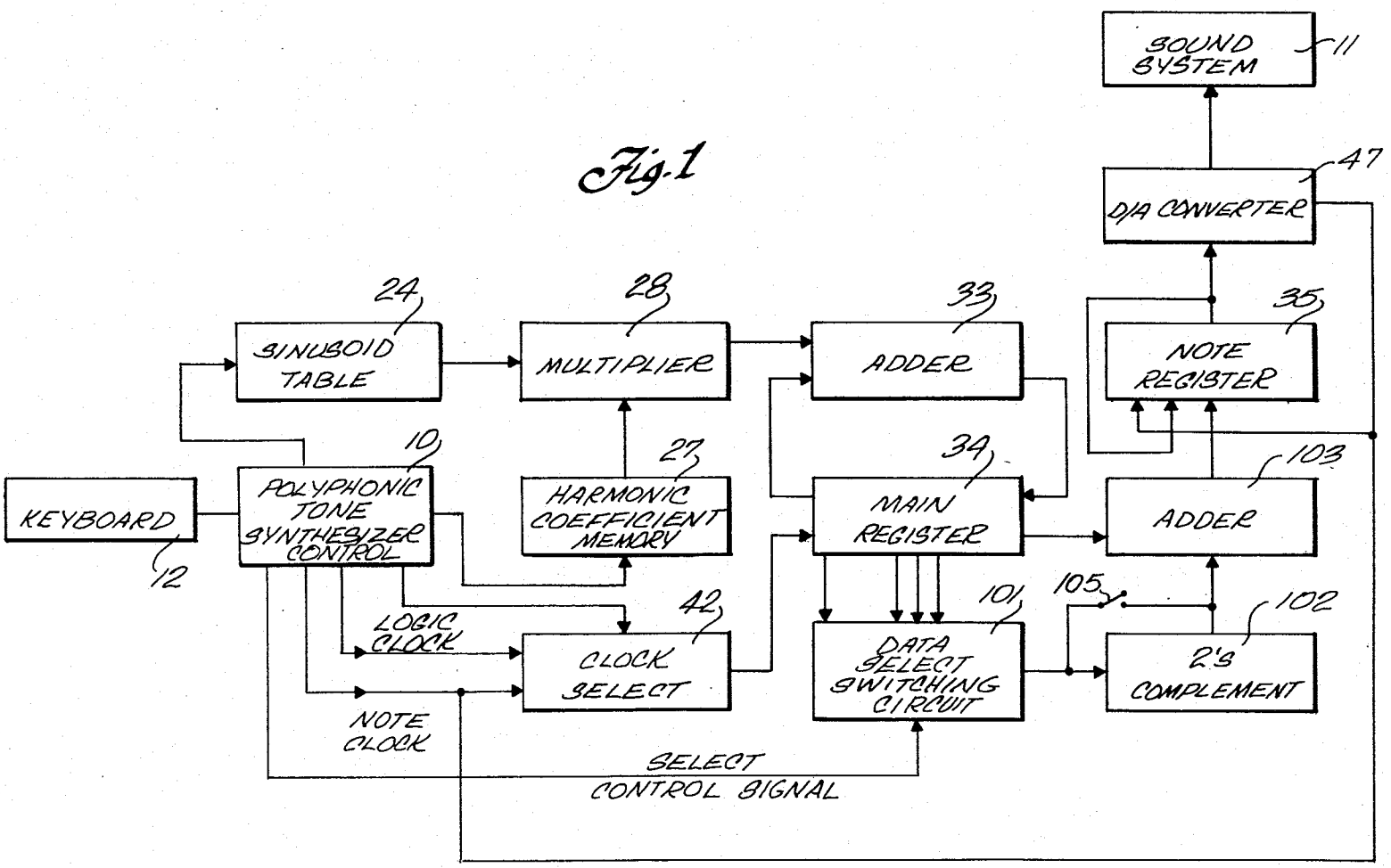
FIG. 1 is a schematic block diagram of one embodiment of the present invention.

The arrangement shown in FIG. 1 is based on the polyphonic tone synthesizer described in U.S. Pat. No. 4,085,644. However, the invention can also be applied to other known types of digital and analog tone generators, as will become apparent as the description proceeds.

The polyphonic tone synthesizer described in the above-identified application includes a computation mode in which a master data set representing the relative amplitudes of a plurality of points on one cycle (or half cycle) of a repetitive audio waveform are calculated and stored in a main shift register at a relatively high speed clock rate. The data stored in the main register is then transferred to a Note register at a clock rate determined by the fundamental frequency of the tone being generated. The master data set is then repetitively read out from the Note register at the note frequency to a digital-to-analog converter which converts the data set to a periodic audio signal having the desired waveform. The master data set is calculated by multiplying the sine values for each of the harmonics by the respective harmonic coefficient values and accumulating the sum of these calculated values for each of the corresponding points in the final waveform.

As described in detail in the above-identified pending application, the master data set is calculated according to the discrete Fourier transform:

$$x_N = \sum_{q=1}^{W} c_q \sin \frac{\pi}{W} N_q \tag{1}$$

where W is the total number of harmonics, N designates a word in the master data set, q is the number designating each of the harmonics. The value of x for the word N+k in the data set can then be written as $$x_{N+k} = \sum_{q=1}^{W} c_q \sin \frac{\pi}{W} q(N+k) \tag{2}$$

The difference of two such data words is then $$\Delta_k = x_{N+k} - x_k = \sum_{q=1}^{W} c_q \left[ \sin \frac{\pi}{W} q(N+k) - \sin \frac{\pi}{W} qN \right] \tag{3}$$

By use of well known trigonometric identities, equation 3 can be rewritten in equivalent form as $$\Delta_k = \sum_{q=1}^{W} c_q \, 2 \sin \frac{\pi q k}{2W} \sin \left( \frac{\pi}{W} qN + \theta \right) \tag{4}$$

where $$\tan\theta = \frac{\sin\frac{\pi qk}{W}}{\cos\frac{\pi qk}{W}} - 1 \quad (5)$$

It will be seen that equation 4 is substantially the same as equation 1 except that the harmonic coefficient $c_q$ is multiplied by a scale factor 2 sin $\pi qk/2W$. The phase factor $\theta$ can be ignored since it is of no importance because the ear is insensitive to relatively small phase changes. Thus it will be seen that the effect of applying a scale factor to the harmonic coefficient can be obtained by a delay and subtraction process represented by equation 3, where K determines the amount of delay.

As described in the above-identified pending application, the effect of a sliding formant filter can be obtained by applying a varying scale factor to the harmonic coefficients used in calculating the master data set. Equations 3 and 4 show that it is possible to obtain the equivalent of applying a scale factor to the harmonic coefficient values by using a delay and subtraction operation.

Referring to FIG. 1 in detail, numeral 10 indicates generally a control for a polyphonic tone synthesizer of the type described in the above-identified application. In response to operation of one or more keys on a keyboard 12, the polyphonic tone synthesizer control 10 initiates a computation cycle in which a master data set is calculated and stored in a main register 34. Each word in the master data set in the main register 34 corresponds to the amplitude of a different sample point on the waveform. The set of words correspond to one cycle of the audio tone being generated. The polyphonic tone synthesizer controls a computational algorithm according to equation 1 above. Thus a sinusoid value is read out of the table 24 and multiplied by a harmonic coefficient from memory 27 by means of multiplier 28 for each harmonic. This value is accumulated or added to the amplitudes of the same data point of the other harmonics by means of an adder 33. The resulting words forming the master data set in the main register 34 correspond to the sum of the amplitudes of all the harmonics for each of the data points. The computation takes place at a relatively high speed logic clock rate derived from a clock source in the polyphonic tone synthesizer control 10. A clock select circuit 42 applies the logic clock pulses to shift the main register 34 during the computational mode.

After the master data set representing the waveform of a tone to be generated is computed and stored in the main register 34, the master data list is shifted from the main register into a Note register 35 at a note clock rate. Note clock pulses are derived from the control 10 at a frequency which is determined by the pitch frequency of the key operated on the keyboard 12. Once the master data set is shifted to the Note register 35, the words are circulated continuously in the register at the note clock rate. Each word read out of the register in succession is applied to a digital-to-analog converter which converts the sequence of digital words to an analog voltage. The analog voltage, which has the desired audio waveshape, is applied to the sound system 11.

As thus far described, the circuit of FIG. 1 corresponds to the polyphonic tone synthesizer described in detail in the above-identified copending application. According to the present invention, the data words shifted out of the main register 34 to the Note register 35 are applied to one input of a digital adder 103. The other input to the adder 103 is derived from any one of the word storage locations in the main register 34 by a data select switching circuit 101. The data select switching circuit is controlled in response to a select control signal which may be derived, for example, from a manually controlled switch or from the ADSR generator in the polyphonic tone synthesizer control 10. The ADSR generator normally controls the attack, decay, sustain, and release of the tone being generated. By using the ADSR signal to control the data select switching circuit 101, the change in the harmonic characteristics of the tone being generated with time is correlated with the attack, decay, sustain and release of the tone being generated. However, the specific manner in which the data select switching circuit 101 is controlled is not material to the present invention.

Figure 2:
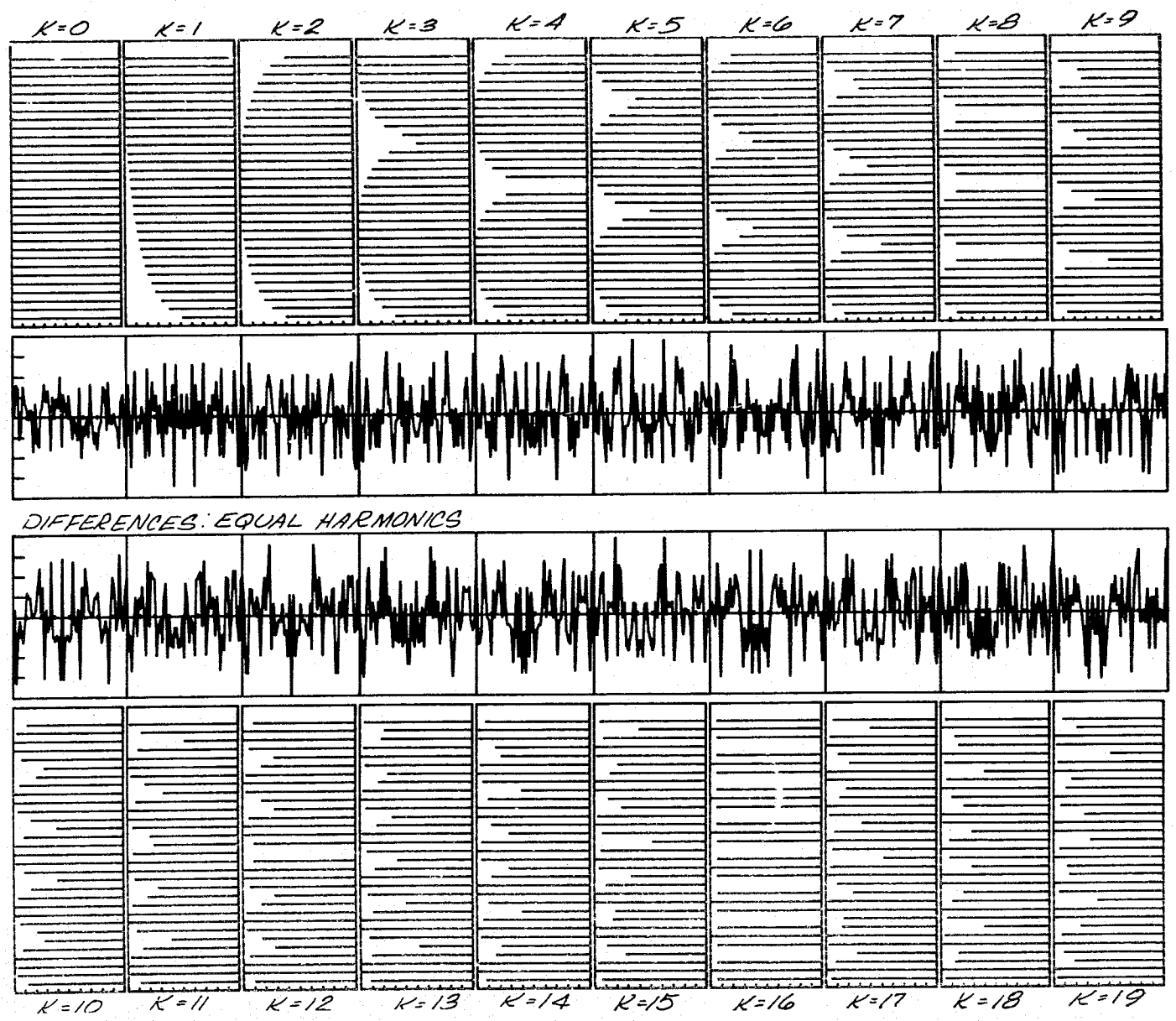
FIG. 2 illustrates the frequency response of the circuit of FIG. 1 with different delay values.

The word in the selected location in the main register 34 is transferred by the data select switching circuit 101 through a 2's complement circuit 102 to the other input of the adder 103. The result is that a delayed word in the master data set of the main register 34 is subtracted from the current word from the main register 34, the difference being stored in the Note register 35. The amount of delay of course is determined by which the word locations in the main register 34 is selected by the switching circuit 101. The net result is that the data transferred to the Note register 35 corresponds to the difference values $\Delta^k$ of equation 4, where k is determined by the setting of the data select switching circuit. Thus the data select switching circuit 101, 2's complement circuit 102, and adder 103 operate as a sliding formant filter for modifying the waveshape represented by the master data set as it is transferred from the main register 34 to the Note register 35. The frequency response of this filter is illustrated in FIG. 2. The upper left spectrum in FIG. 2 corresponds to the waveform generated from the data in the main register without modification. The data residing in the main register 34 resulting in this spectrum was computed for a waveshape having thirty-one equal harmonic coefficients. The next spectrum corresponds to inputs to the adder 103 separated by one word position, and each successive spectrum is for an additional word separation, corresponding to $k=1,2,3,\ldots 19$. It will be seen that for values of k in the range of $1 \leqq k \leqq 6$, the filter acts somewhat as a high pass filter and exhibits a sliding formant effect.

Figure 3:
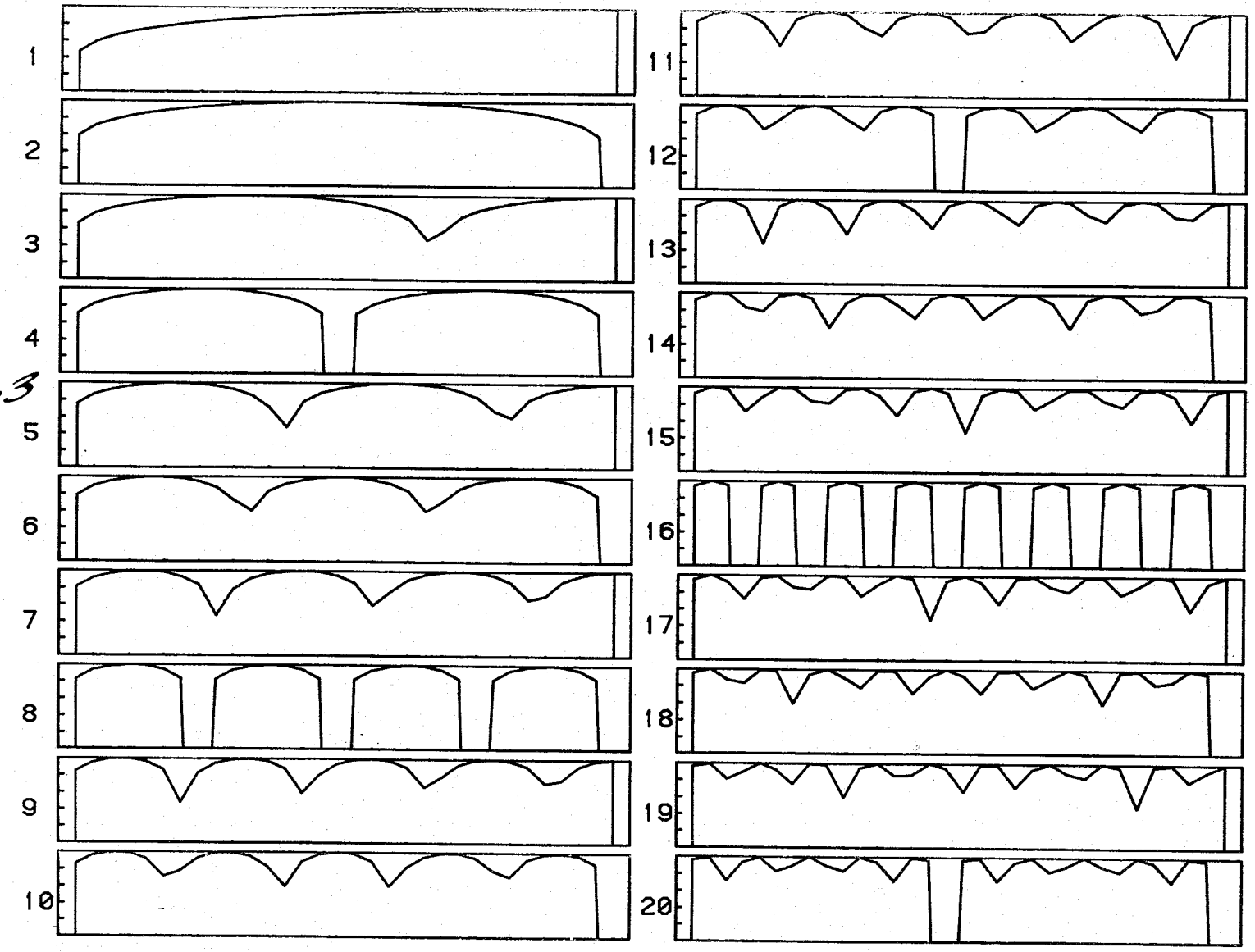
FIG. 3 illustrates the gain response of the filter arrangement of FIG. 1 where the delay data point is subtracted from the current data points.

FIG. 3 illustrates the gain response of the filter arrangement of FIG. 1 as defined by the relation $$G_1 = 20\log_{10} 2\sin\left(\frac{\pi qk}{2W}\right)/2 \quad (6)$$

The numbers of the waveforms correspond to the values of k, namely, the word address separation of the two words from the shift register applied to the adder. The gain is plotted as a function of q which varies from 1 to 32, assuming that the number of harmonics W is selected as 32. As shown by FIG. 3, for $k=1$, the gain goes to zero for the lowest order harmonic and increases with the higher order harmonics, thus providing the gain characteristics of a high pass filter.

Referring again to FIG. 1, a switch 105 may be provided to inhibit or bypass the 2's complement circuit 102 so that the current word and delayed word are added instead of subtracted. The gain curve for added increments has the form $$G_1' = 20 \log_{10} 2 \cos\left(\frac{\pi qk}{2W}\right) /2 \quad (7)$$

Figure 4:
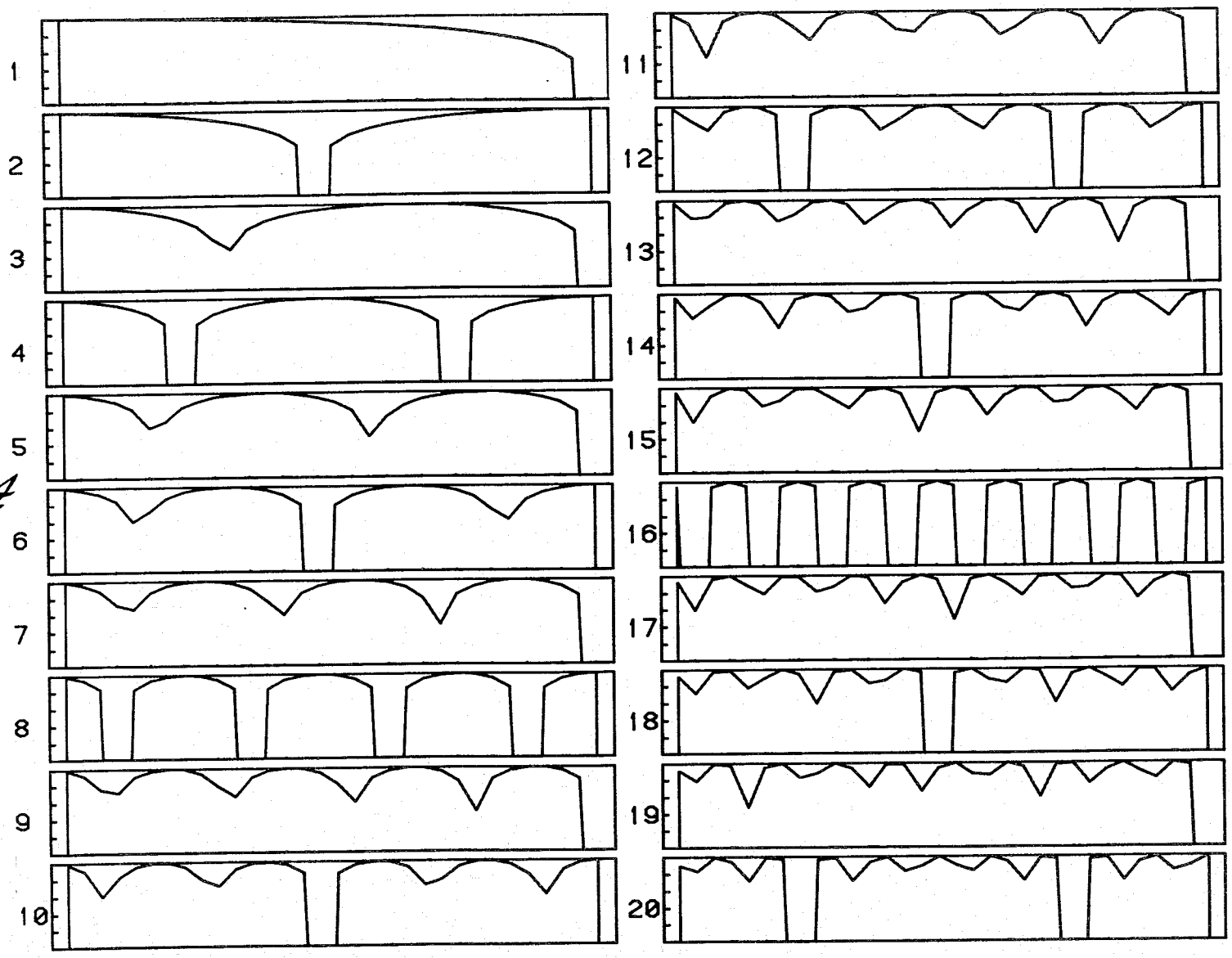
FIG. 4 illustrates the gain response where the delay point is added to the current data points.

FIG. 4 illustrates the gain curves for the added increments for various values of k. It will be seen that with k=1 the gain drops off at the higher harmonics, thus giving the filtering effect of a low pass filter. The cutoff frequency of successive values of k is reduced. Thus varying k has the effect of providing a sliding formant filtering effect.

Figure 5:
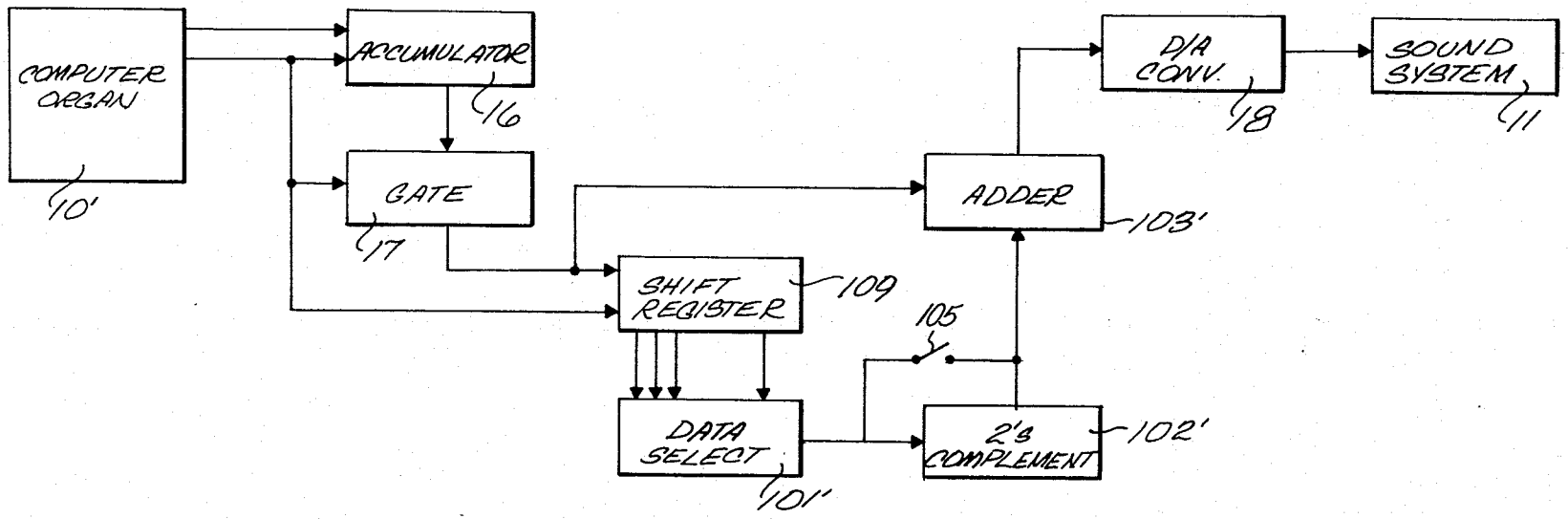
FIG. 5 is a schematic block diagram of the invention incorporated in a real-time computer organ.

The invention as described in connection with FIG. 1 may also be incorporated in a computer organ of the type described in U.S. Pat. No. 3,809,786. Referring to FIG. 5, as described in the above-identified patent, a computer organ, indicated generally at 101 in FIG. 4, computes a series of data points in real time, each data point value being stored temporarily in an accumulator 16. At fixed clock intervals, each data point value is transferred out of the accumulator 16 through a gate 17 to a digital-to-analog converter 18. Successive data point values are connected to an analog voltage which is applied to the sound system 11. The invention is incorporated by applying the output of the gate 17 to the digital-to-analog converter 18 through an adder 103'. The adder 103' modifies each data point value by adding to its the value of an earlier calculated data point value temporarily stored in a shift register 109. Each data point value as it is calculated and gated out by the gate 17 is shifted into the register 109. Any one of the prior data point values stored in the shift register 109 is selected by a data select circuit 101' and applied to the adder 103' through a 2's complement circuit 102'. Except that the data point values are generated in real time, the circuit of FIG. 5 operates to modify the harmonic content of the resulting analog waveform in the same manner as described above in connection with FIG. 1.

Figure 6:
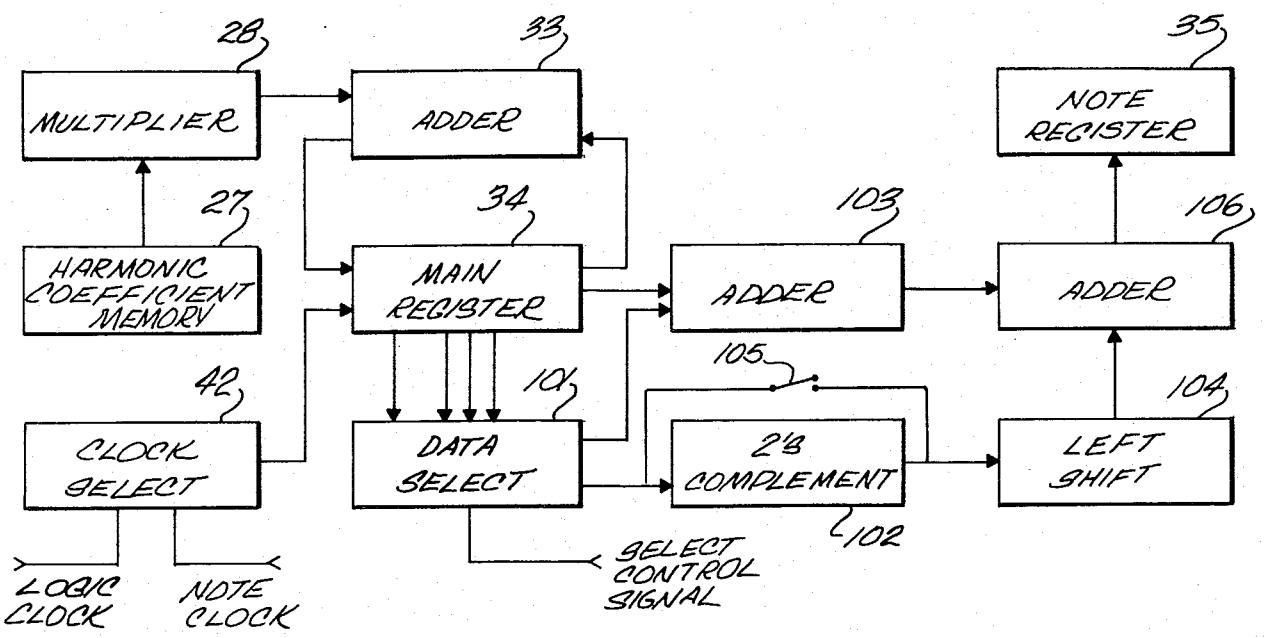
FIG. 6 is a schematic block diagram of a modifed embodiment of the present invention.

The difference modulation systems described above may be referred to as a "first difference" modulation system, since each resultant value is produced by a single subtraction. The circuit of FIG. 6 illustrates a system using a "second difference" modulation system. If successive data points are $X_n$, $X_{n+k}$, and $X_{n+2k}$, etc., then the second difference is defined as $$\Delta_2 = x_{n+2k} - 2x_{n+k} + x_n \quad (8)$$

Using the definitions given in equations 1 and 2 above, the second difference may be expressed as $$\Delta_k = \sum_{q=1}^{W} c_q \sin\frac{\pi q}{W}(N+2K) - 2\sin\frac{\pi q}{W}(N+k) + \sin\frac{\pi q}{W} N \quad (9)$$

Written in equivalent form equation 9 becomes $$\Delta_k = \sum_{q=1}^{W} c_q B \sin\left(\frac{\pi qN}{W} + \phi\right) \quad (10)$$

-continued $$B^2 = 4\cos^2\frac{\pi q}{W} k + 4\left(3\text{-}4\cos^2\frac{\pi qk}{2W}\right) \quad (11)$$

Figure 7:
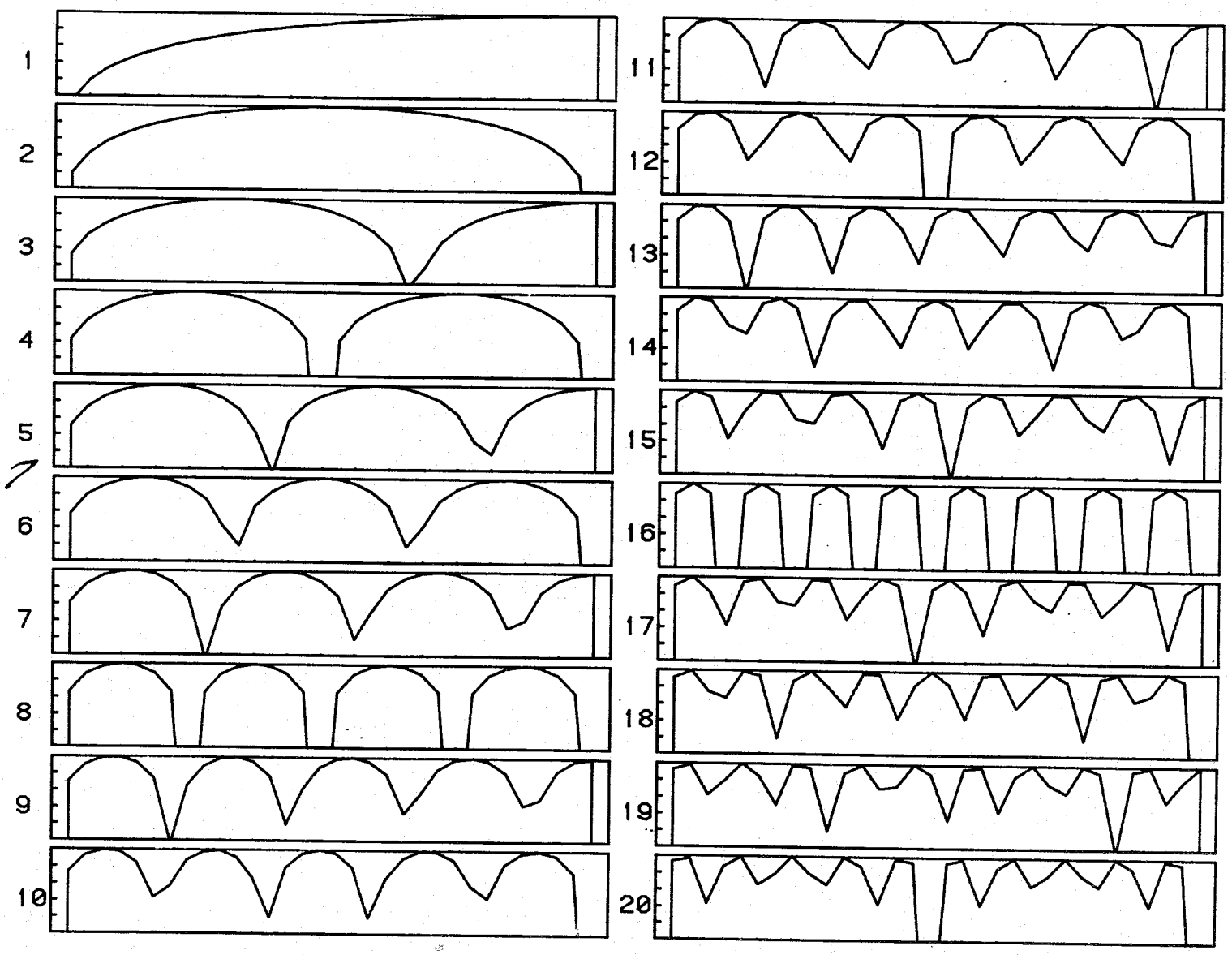
FIGS. 7 and 8 show the gain response for the circuit arrangement of FIG. 6, respectively, for a subtraction and an addition circuit.

FIG. 7 shows the gain characteristic for second difference values of $B^2$ expressed in db units according to the relation $$G_2 = 10 \log_{10} B^2/4 \quad (12)$$

Figure 8:
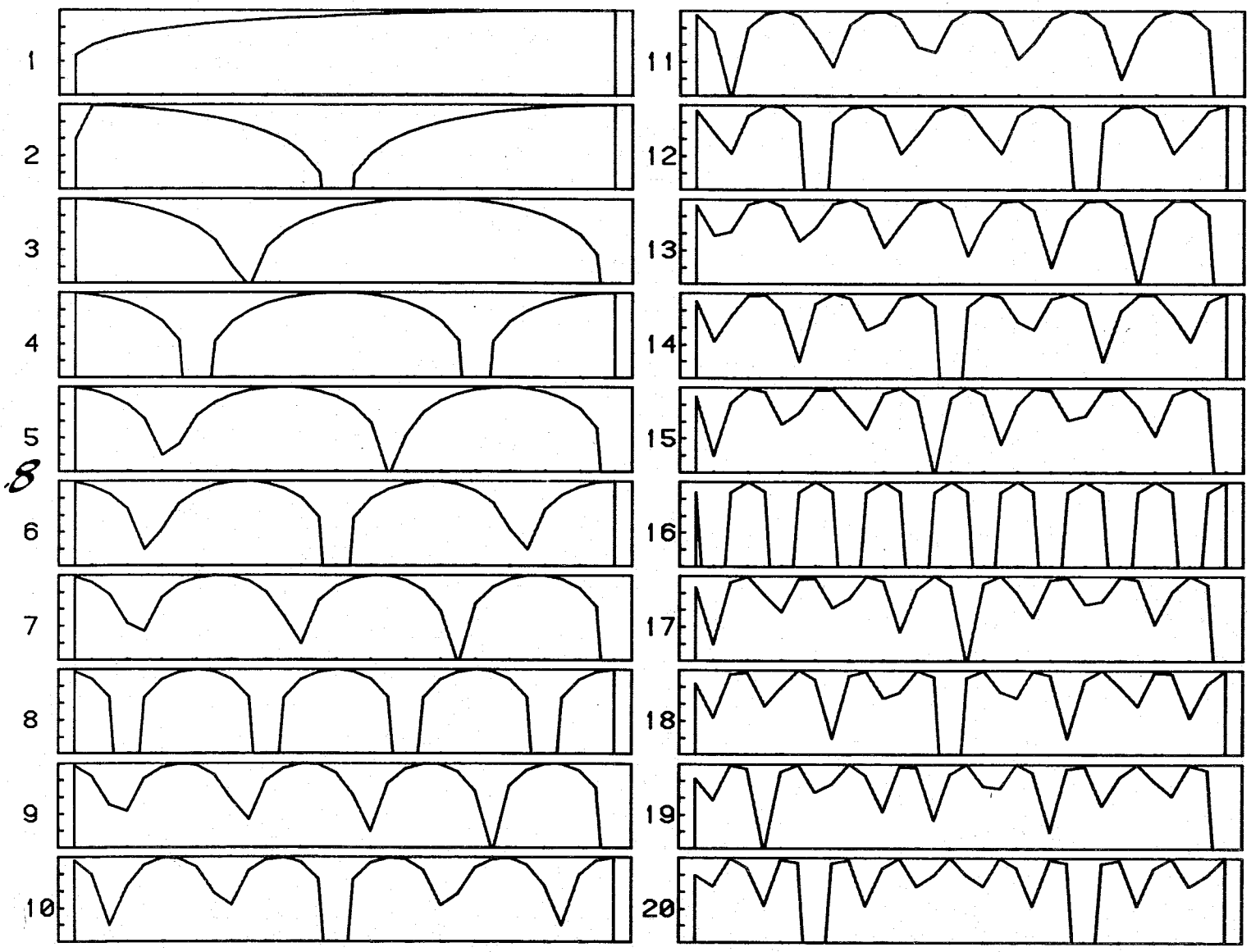

FIG. 8 shows the gain characteristics for the second sum modulation.

Referring to FIG. 6, the block diagram for the second difference modulation scheme is shown in block diagram form. The circuit is substantially the same as that shown in FIG. 1 except the output of the adder 103 is applied to one input of a second adder 106. The output of the 2's complement circuit 102 is applied to the second input of the adder 106 through a left shift circuit 104. The left shift of one digit in binary is the same as multiplying by 2, as required by the second term of equation (8). Thus the output of adder 105 corresponds to the second difference $\Delta_2$. By bypassing the 2's complement circuit 102, the second sum modulation can be obtained.

What is claimed is:

1. A tone synthesizer comprising: means generating a plurality of digital words in sequence at a predetermined rate at a first output, said words defining the amplitude of spaced points on the waveform of a periodic analog signal, means generating the same sequence of digital words at a second output at the same rate but delayed in time an integral multiple of the sequence time between successive words, means subtracting each word generated at the first output from the coincident word from the second output to generate a resultant word, and a digital-to-analog converter coupled to the output of the subtracting means for converting the resultant words to an analog voltage signal.

2. Apparatus of claim 1 wherein the means generating a plurality of digital words includes a shift register storing a group of digital words corresponding in value to the amplitudes of equally spaced points along one cycle of an audio signal, means shifting the words out of a first word location in the register in repetitive sequence to the first output, and means shifting the words out of a second word location in the register to the second output.

3. A tone synthesizer comprising means generating in timed sequence a first series of digitally coded words, the words corresponding in value to the amplitudes of a series of successive points defining the waveform of a musical tone, delay means generating in timed sequence a second series of digitally coded words identical to the first series but delayed in time by an integral multiple of the time between successive words in said first series, means for changing said integral multiple at controlled time intervals to vary the time relation between the words in the first and second series, subtraction means receiving the first and second series of words for subtracting each word in the second series at the time it is received from a word received at the same time in first series to generate a third series of digitally coded words corresponding in value to the difference between the first and second series, digital-to-analog converter means for converting the third series of digitally coded words to an analog signal varying in amplitude in proportion to changes in the value of the sequence of words in said third series, means transferring said third series of digitally coded words to the converter means, and means for producing an audio tone in response to said analog signal.

4. Apparatus for modifying the waveform of an audio signal comprising: a source of digitally coded data words representing the amplitudes of sequential points of a cycle of an audio signal, timing means for transferring said data words from said source in timed sequence to a first output, means including variable time delay means for transferring said same data words from said source in timed sequence at the same rate but delayed in time to a second output, the delay time being an integral multiple of the time between successive data words at said first output, arithmetic means for selectively and continuously adding or subtracting each of the delayed amplitude data words from the second output from a concurrent undelayed data word from said first output to generate output data words in timed sequence proportional to the sum or difference in instantaneous amplitude of undelayed data words from said source and delayed data words, and means responsive to said output data words of said arithmetic means for converting the resulting data words in said output to an analog audio signal whose instantaneous amplitude varies in proportion to the changes in the value of said output data words.

5. Apparatus of claim 4 wherein said data from the data source changes in periodic manner and the time delay of the delay means is a small fraction of the time period of the periodic data.

6. Apparatus of claim 4 wherein the delay means includes means to vary the amount of delay in increments of time corresponding to the time between two sequential data points.

7. Apparatus of claim 6 wherein said delay means includes means connected to said source for temporarily receiving and storing a group of said digital words on a first in, last out basis.

8. The apparatus of claim 7 wherein said delay means includes means for selecting any word in said group for the output to the subtracting means.

* * * * *

UNITED STATES PATENT AND TRADEMARK OFFICE

CERTIFICATE OF CORRECTION

PATENT NO. : 4,281,574

DATED : August 4, 1981

INVENTOR(S) : Ralph (nmi) Deutsch

It is certified that error appears in the above—identified patent and that said Letters Patent is hereby corrected as shown below:

Col. 1, line 16, "aduio" should read -- audio --;
line 46, "substracting" should read -- subtracting --;
line 49, "substraction" should read -- subtraction --;
line 58, "digial-" should read -- digital- --.
Col. 2, line 3, "points" should read -- point --;
line 5, "points" should read -- point --.
Col. 4, line 30, "$\Delta^k$" should read -- $\Delta_k$ --;
line 47, "≦" should read -- ≤ --.
Col. 5, line 13, "of" (first occurrence) should read -- for --;
line 20, "FIG. 4" should read -- FIG. 5 --;
line 26, "connected" should read -- converted --;
line 32, "its" should read -- it --.

Signed and Sealed this

Sixteenth Day of February 1982

[SEAL]

Attest:

GERALD J. MOSSINGHOFF

Attesting Officer

Commissioner of Patents and Trademarks